US005468004A

United States Patent [19]

Olson et al.

[11] Patent Number: 5,468,004

[45] Date of Patent: Nov. 21, 1995

[54] ANTI-LOCK BRAKE FOR IN-LINE SKATE

[75] Inventors: Scott B. Olson, Minneapolis; Louis F. Polk, III, Excelsior; Adam A. Luedke, Minnetonka, all of Minn.

[73] Assignee: O.S. Designs, Inc., Waconia, Minn.

[21] Appl. No.: 439,698

[22] Filed: May 12, 1995

Related U.S. Application Data

[63] Continuation of Ser. No. 99,233, Jul. 29, 1993, abandoned.

[51] Int. Cl.[6] ..... A63C 17/14

[52] U.S. Cl. ..... 280/11.2

[58] Field of Search ..... 280/11.27, 11.19, 280/11.2, 11.23, 11.22, 87.041, 87.042, 11.24, 11.25, 11.26, 11.28; 188/5, 29, 74, 177

[56] References Cited

U.S. PATENT DOCUMENTS

| | | | |
|---|---|---|---|
| 182,835 | 10/1876 | Lockwood | 280/11.2 |
| 1,150,966 | 8/1915 | Ries | 280/11.2 |
| 1,154,510 | 9/1915 | Harrell | 280/11.2 |
| 1,176,074 | 3/1916 | Malcolm | 280/11.2 |
| 1,371,623 | 3/1921 | Ickenroth | 280/11.2 |
| 1,402,010 | 1/1922 | Ormiston | 280/11.2 |
| 1,497,224 | 6/1924 | Ormiston | 280/11.2 |
| 1,628,004 | 5/1927 | Stetson | 280/11.2 |
| 1,801,205 | 4/1931 | Mirick | 280/11.2 |
| 1,869,612 | 8/1932 | Padgett | 280/11.2 |
| 2,027,487 | 1/1936 | Means | 280/11.2 |
| 3,749,413 | 7/1973 | Nicolson | 280/11.2 |
| 3,767,220 | 10/1973 | Peterson | 280/11.2 |
| 3,823,952 | 7/1974 | Kukulowicz | 280/11.2 |
| 3,900,203 | 8/1975 | Kukulowicz | 280/11.2 |
| 3,904,215 | 7/1975 | Bardy | 280/11.2 |
| 4,050,705 | 9/1977 | Kreis | 280/11.2 |
| 4,076,266 | 2/1978 | Krausz | 280/11.2 |
| 4,108,451 | 8/1978 | Scheck, Sr. | 280/11.2 |
| 4,183,546 | 1/1980 | Heilig | 280/11.2 |
| 4,194,751 | 3/1980 | Shinmura | 280/11.2 |
| 4,295,547 | 10/1981 | Dungan | 280/11.2 |
| 4,300,781 | 11/1981 | Riggs | 280/11.2 |
| 4,805,936 | 2/1989 | Krantz | 280/11.2 |
| 4,807,893 | 2/1989 | Huang | 280/11.2 |
| 4,943,072 | 7/1990 | Henig | 280/11.2 |
| 4,943,075 | 7/1990 | Gates | 280/11.2 |
| 5,067,736 | 11/1991 | Olson et al. | 280/11.2 |
| 5,088,748 | 2/1992 | Koselka et al. | 280/11.2 |
| 5,171,032 | 12/1992 | Dettmer | 280/11.2 |
| 5,183,275 | 2/1993 | Hoskin | 280/11.2 |
| 5,183,276 | 2/1993 | Pratt | 280/11.2 |
| 5,183,277 | 2/1993 | Tang | 280/11.2 |
| 5,183,292 | 2/1993 | Ragin, III | 280/11.2 |
| 5,192,088 | 3/1993 | Yu | 280/11.2 |
| 5,192,099 | 3/1993 | Riutta | 280/11.2 |
| 5,257,795 | 11/1993 | Babcock | 280/11.2 |

*Primary Examiner*—Richard M. Camby
*Attorney, Agent, or Firm*—Haugen and Nikolai

[57] ABSTRACT

An anti-lock brake for in-line skates, skateboards, or the like. The brake is adapted to be selectively secured to the wheel frame proximate the rear wheel and comprises a pivoting tongue member engaging the circumference or ground engaging surface of the rear wheel when an integral braking skid pad is caused to firmly engage the ground. A resilient member resiliently inhibits the tongue member for engaging the rear wheel except during a severe braking operation. The skid pad remains the primary braking mechanism, and the tongue provides a second anti-lock braking mechanism. The tongue of the pivoting member has a concave surface closely conforming to the contour of the rear wheel to minimize tire wear, and further insures that wear does not distort the shape of the wheel. A large contact surface is established when the braking tongue engages the wheel to distribute the heat generated therebetween to reduce the chance of the wheel melting.

18 Claims, 2 Drawing Sheets

ANTI-LOCK BRAKE FOR IN-LINE SKATE

This is a continuation of application Ser. No. 08/099,233 filed on Jul. 29, 1993 now abandoned.

FIELD OF THE INVENTION

This invention relates generally to in-line skates, skate boards or the like, and more particularly to an anti-locking braking device for selectively slowing the skating device when in motion.

BACKGROUND OF THE INVENTION

In-line skates have been dramatically improved in recent years such that skaters can attain speeds in excess of 60 miles an hour. Improvements in wheels, bearings, and aerodynamics have all contributed to facilitate high speeds. Whether the in-line skate is used for racing or just for pleasure, the skater needs a safe, effective and reliable braking device to selectively slow themselves while in use, or to stop.

In-line skating devices typically employ a braking device at the rear of the skate, proximate the rear wheel, rather than proximate the toe of the skate to avoid sending the user tumbling during a braking procedure. When the skater is travelling at high speeds, sophisticated braking assemblies need to be employed so that the braking operation can be undertaken with a minimal amount of effort and in a safe manner. While a simple brake pad disposed proximate the rear wheel may be sufficient in many instances, a secondary or alternative means for braking may also needed.

U.S. Pat. No. 5,171,032, issued to Dettmer discloses a cable operated braking means. By retracting the cable using a hand-held device, a plurality of brake pads can be selectively caused to engage one or more wheels in the wheel carriage or truck assembly to slow the wheels. While this device may be suitable for some applications, it is a custom designed-device which may be more prone to failures due to its complexity. Further, as there are a variety of wheel carriage assemblies on the market, this device is suitable to only a select few of carriages, and thus, may have more limited application to off-the-shelf devices.

U.S. Pat. No. 5,088,748 to Koselka et al. discloses an anti-lock braking assembly including a four bar linkage for selectively urging a braking member upon the rear wheel hub of a wheel carriage. This device includes an auxiliary fifth wheel which when caused by the skater to engage the ground will consequently cause a respective arm to engage the wheel hub on each side of the wheel, thus slowing rotation of the rear wheel. This device necessarily requires a sufficient clearance on each side of the wheel for the arms to engage the wheel hub, which is not the case in most commercially available in-line wheel carriage assemblies. In an alternative embodiment of this invention, a pair of arms are employed in lieu of the four bar linkage to, again, engage the wheel hub. The contact area between the pair of arms and the hub is rather limited since the hub has a small diameter. Thus, a tremendous amount of heat can be generated to each of the elements during an extensive braking operation. Since the surface area of the wheel hub is pre-determined, increasing the diameter of the hub is not practical or feasible.

U.S. Pat. No. 5,183,275 to Hoskin teaches a brake implementing an articulated mounting that causes a roller to engage the rear wheel to retard rotation thereof. This invention recognizes a need to provide a second braking means, but requires modifying the wheel carriage to pivotally receive the upper articulated member. U.S. Pat. No. 5,192,099 to Riutta teaches a stopping aid comprising a brake pad which engages the rear wheel when weight is concentrated thereon, causing a webbed portion to flex. This device may be difficult for the user to get accustomed to since a large weight may need to be applied to the rear wheel, thus affecting the skater's balance.

OBJECTS

It is accordingly a principle object of the present invention to provide an anti-locking braking device suitable for in-line skates or the like.

It is a further object of the present invention to provide an improved anti-lock braking device including more than one braking mechanism yet which is inherently simple in design to reduce the chance of failure while in use, and which is easy to use to maintain a skater's balance.

Still yet a further object of the present invention is to provide an anti-lock braking device which produces an acceptable amount of heat even during the most extensive braking operations, such as during a high-speed race.

Another object of the present invention is to provide an anti-lock braking device which is readily and selectively securingly adaptable to many commercially available in-line skating assemblies, which can be easily and quickly adapted to or removed therefrom, which is inexpensive, and easy to use.

Still yet another object of the present invention is to provide an anti-lock braking device wherein the second braking mechanism of the brake can be selectively engaged only after the first braking mechanism is engaged, and which may or may not be simultaneously engaged therewith.

Other objects, features and advantages of the present invention will become apparent to those skilled in the art through the Description of the Preferred Embodiment, Claims, and drawings herein, wherein like numerals refer to like elements.

SUMMARY OF THE INVENTION

The foregoing objects and advantages of the present invention are achieved by providing an anti-lock brake readily adaptable to the wheel carriage of an in-line skate, proximate the rear wheel, wherein a member is pivotably disposed in a housing and has a first end for selectively engaging the ground, and an opposite end extending proximate the circumference of the rear wheel such that by urging the brake pad against the ground, the opposite end frictionally engages the circumference of the rear wheel.

More particularly, the anti-lock braking device comprises a housing having a forward portion selectively securingly coupable to a wheel frame proximate the rear wheel. A braking device or arm is pivotably coupled to the housing at a pivot point. The arm has a ground engaging end and a braking device defined on opposite sides of the pivot point, said braking device capable of selectively slowing the device when in motion. The arm ground engaging end is adapted to be selectively engaged by the skater with the ground. The braking device is disposed adjacent the rear wheel ground engaging surface or circumference such that when the brake is adapted to the skating device proximate the rear wheel, when the arm ground engaging end is caused by the skater to engage the ground, the arm pivots about the pivot point such that the braking means is responsively caused to be urged against the rear wheel ground engaging surface, which is the circumference of the wheel. Preferably, the first ground engaging end is comprised of a brake skid pad but could also comprise an auxiliary wheel, and the oppositely disposed braking means is comprised of a tongue having a conforming concave surface facing the rear wheel ground engaging surface. The tongue is elongated and has a radius substantially equal to the radius of the rear wheel such that when the tongue engages the circumference of the wheel, a large contact surface is established to minimize heat which may be produced, and to reduce uneven wear of the rear wheel.

In a preferred embodiment of the invention, a device for resiliently restraining the braking mechanism from engaging the rear wheel ground engaging surface until a large force is imposed on the ground engaging brake skid pad is provided by the skater. Preferably, this resilient device is securingly disposed between the arm and the housing, and more preferably is disposed along the arm between the pivot point and the brake skid pad. A piece of resilient rubber or urethane is preferable having a finger engaging the arm.

Preferably, the housing is U-shaped and is defined by a pair of side members and an end member extending therebetween to together define a clearance. The side members each have a distal end adapted to securingly receive the wheel frame proximate the rear wheel. Thus, the U-shaped housing can be easily removed or attached to the wheel frame, and is designed to be adaptable to a variety commercially available skating devices.

One unique feature of the preferred embodiment is that the tongue is defined in-line or planar with the radius of the rear wheel to provide a symmetrically designed wheel and brake apparatus. Thus, when the arcuate-shaped tongue is caused to urge the circumference of the wheel, the rotational speed of the rear wheel is retarded and caused to decrease without using a force applied on either side of the wheel, such as on the hub, which could cause the user to lose his balance. Thus, a single large wheel engaging surface is provided by the concave elongated surface of the tongue, which also has the effect of distributing heat which can be generated therebetween. Still yet another feature of the elongated curved surface of the tongue is that since the radius of the tongue conforms the radius of the wheel, and the cross-section radius of the concave surface conforms to the arcuate concave cross-section of the wheel, while the wheel may become worn over time, it will become worn evenly so as to not degrade performance of the wheel when in use.

DESCRIPTION OF THE PREFERRED EMBODIMENT

Figure 1:
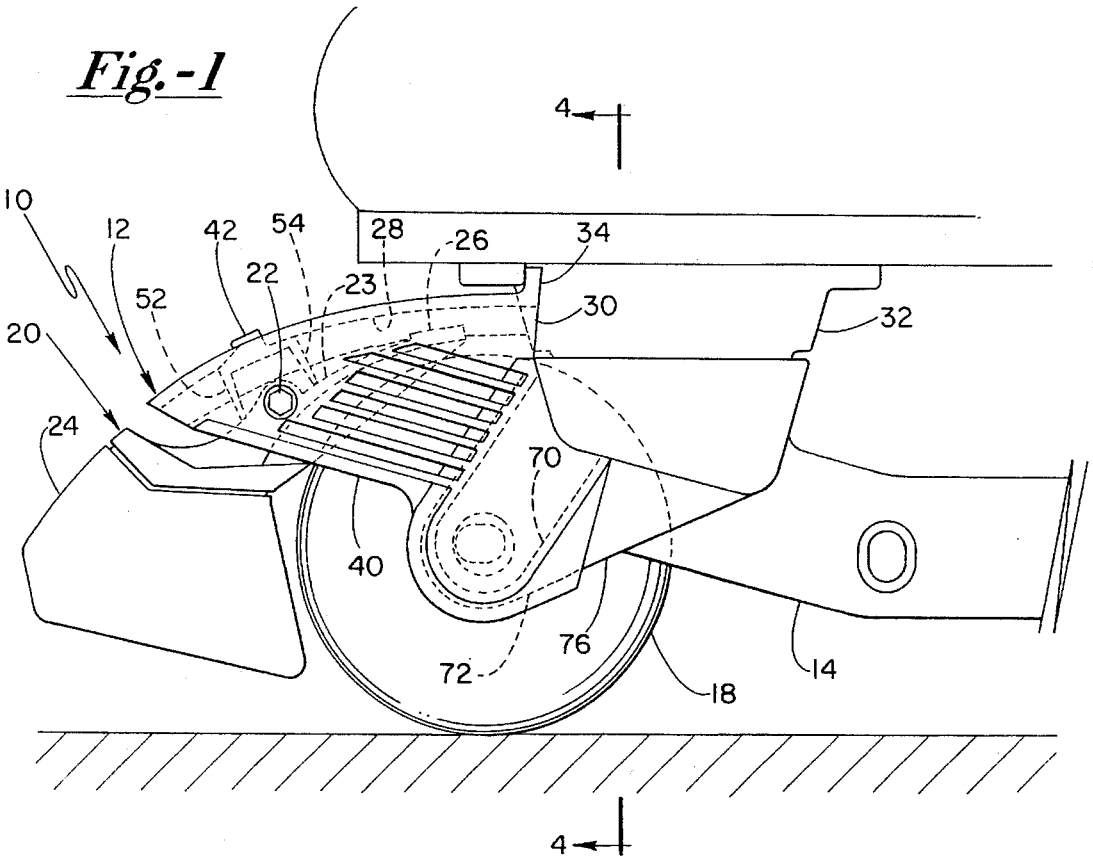
FIG. 1 is a side elevational view of the anti-lock brake adapted to a typical in-line skate with the first braking mechanism or brake pad retracted from the ground and the second braking mechanism or tongue retracted from the skate rear wheel circumference.

Referring now to FIG. 1, an anti-lock braking assembly for an in-line skate is generally shown at 10 attached to an in-line wheel assembly proximate a rear wheel rotatably mounted therein. Wheel assembly 10 comprises two main components. The first component is a rigid U-shaped housing 12 which is selectively coupled to and receives a frame 14 of an in-line wheel assembly defined about an axle 16 extending through the rear wheel 18. The second component is a braking member generally shown at 20 which is pivotably coupled to and partially disposed within housing 12. A fastener 22, such as a hex-head bolt, is securingly disposed through the side members at housing 12 and through an aperture defined in a central portion of member 20 such that member 20 can pivot freely about fastener 22. When the skater wishes to initiate a braking procedure, the toe of the skate is lifted upward such that a ground engaging end or braking pad 24, such as a typical skid pad but which could also comprise of an auxiliary wheel, engages the ground behind rear wheel 18 thus causing member 20 to pivot about member 22 such that the lower-surface of the opposite end 26 engages the outer circumference or ground engaging surface of rear wheel 18 to inhibit and retard rotation of rear wheel 18.

Housing 12 is preferably comprised of a rigid light weight plastic formed in a generally U-shape and defining a clearance therein for pivotably receiving an aluminum arm 23 of member 20. Housing 12 has an opening 28 defined in an upper portion thereof for facilitating access to this clearance from above. The U-shaped housing 12 is defined by a pair of side members 30 each extending toward and abutting the rear surface of heal mounting bracket 32, and securingly receives frame 14 proximate rear wheel 18 as will be discussed shortly in regard to FIG. 4. Each arm 30 is disposed on opposite sides of clearance 28. Each end 30 also includes an upward extending tab portion 34 to maximize the interface between the end of member 30 and the rear portion of heal mounting bracket 32 for leveraging.

Each side member 30 also includes a plurality of parallel integrally defined structural ribs 40 to provide rigidity to respective side member 30. The right and mounting end of each side member 30 includes a slot defined on a inner surface (FIG. 4) thereof which is adapted to securingly and selectively receive a protruding portion of frame 14 defined proximate wheel axle 16. Thus, to selectively remove housing 12 from frame 14, the user simply slides housing 12 downward and rearwardly at an angle. In use, housing 12 is secured to frame 14 via side members 30 in a close friction fit.

Housing 12 also includes a U-shaped resilient member 42, such as a piece of urethane or rubber, which is securingly disposed within housing 12 and proximate arm 23 of member 20, and includes one finger extending each side of pivot member 22 as shown. Both the forward finger 54 and rearward finger 52 of U-shaped member 42 are in contact with the upper surface of arm 23 at respective portions, and are disposed on opposite sides of pivot 22 to establish a normal position for arm 23 as shown in FIG. 1. Thus, rotation of arm 23 about pivot 22 is resiliently inhibited in either direction. Rear finger 52 allows end 26 of arm 23 to remain adjacent to but slightly separated from the outer ground engaging surface of rear wheel 18, and also resiliently restricts brake pad end 24 from engaging rear wheel 18 until a large braking operation is performed by causing skid pad 24 to engage the ground. Forward finger 54 resiliently restricts arm 23 from pivoting such that brake pad 24 remains above ground.

Figure 2:
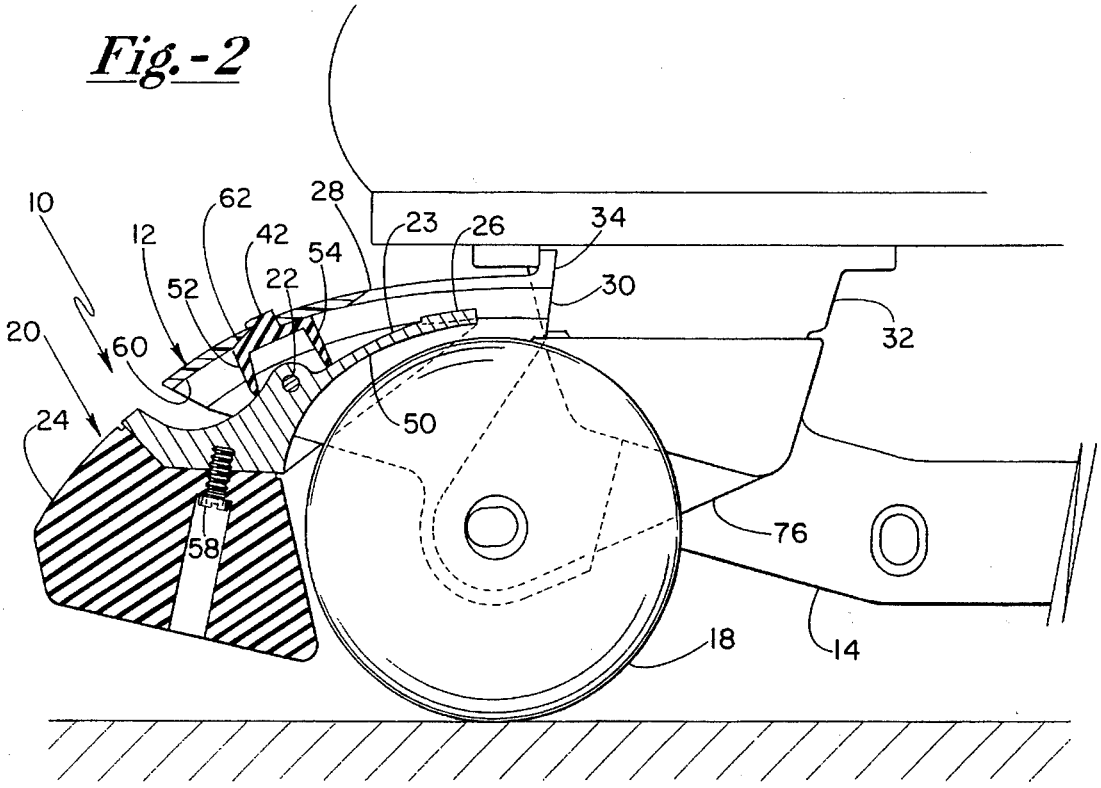
FIG. 2 is a side sectional view illustrating the arcuate shaped arm member pivotably attached to the housing side members in a retracted position such that rear wheel is free to rotate.

Referring now to FIG. 2, a side sectional view of anti-lock brake 10 is shown adapted to the frame 14 proximate rear wheel 18. In this figure, arm 23 is in a normal or retracted position such that an inner concave surface 50 is disposed proximate to but spaced away from the circumference or ground engaging surface of rear wheel 18. This normal position is maintained by resilient member 42, wherein rear finger 52 and forward finger 54 are both in contact with an upper surface of arm 23 each side of pivot member 22, respectively, as shown. Thus, brake or skid pad 24 remains spaced away from rear wheel 18 as well as wheel 18.

The inside concave surface 50 of arm 23 is elongated and has an arcuate shape with a radius substantially equal to the radius of rear wheel 18, as shown in FIG. 2. Arm 23 is divided into essentially two portions, a first portion which extends forward from the central location disposed around pivot fastener 22 and toward end 26, and a second or rear portion disposed between pivot member 22 and skid pad 24. The portion to the left of pivot 22 and proximate skid pad 24 is thicker than the first portion to provide structural rigidity. The entire member or arm 23 is comprised of heat conductive aluminum, however, a rigid lightweight plastic would be suitable as well. Due to the heat that will be generated when inner surface 50 is frictionally engaged upon a rotating rear wheel 18, aluminum is preferred to prevent a possible melting of arm 23 if it were comprised of plastic.

Also shown in FIG. 2 is opening 28 defined between the forward portion of each side member 30 and which is located above end 26 of arm 23. This opening is defined to reduce the overall weight of housing 12, and which forms a rectangular opening when viewed from above such that each arm 30 can be slightly flexed in the lateral direction when adapted to and while abutting rear mounting bracket 32. A fastener 58 is provided for securing the rubber brake pad 24 to arm 23.

Housing 12 also has an arcuate-shaped inner surface 60 for which a shoulder portion 62 of member 42 is engaged against when member 42 is disposed through an opening defined in the outer surface of member 12, as shown. This shoulder 62 extends across the top of pivot member 22 in flush contact therewith to provide sufficient leverage such that respective finger 52 and 54 will bend when member or arm 23 is pivoted in either direction. Member 42 can be easily replaced with a new member should it become damaged or lose its resiliency over time, or due to wear.

Figure 3:
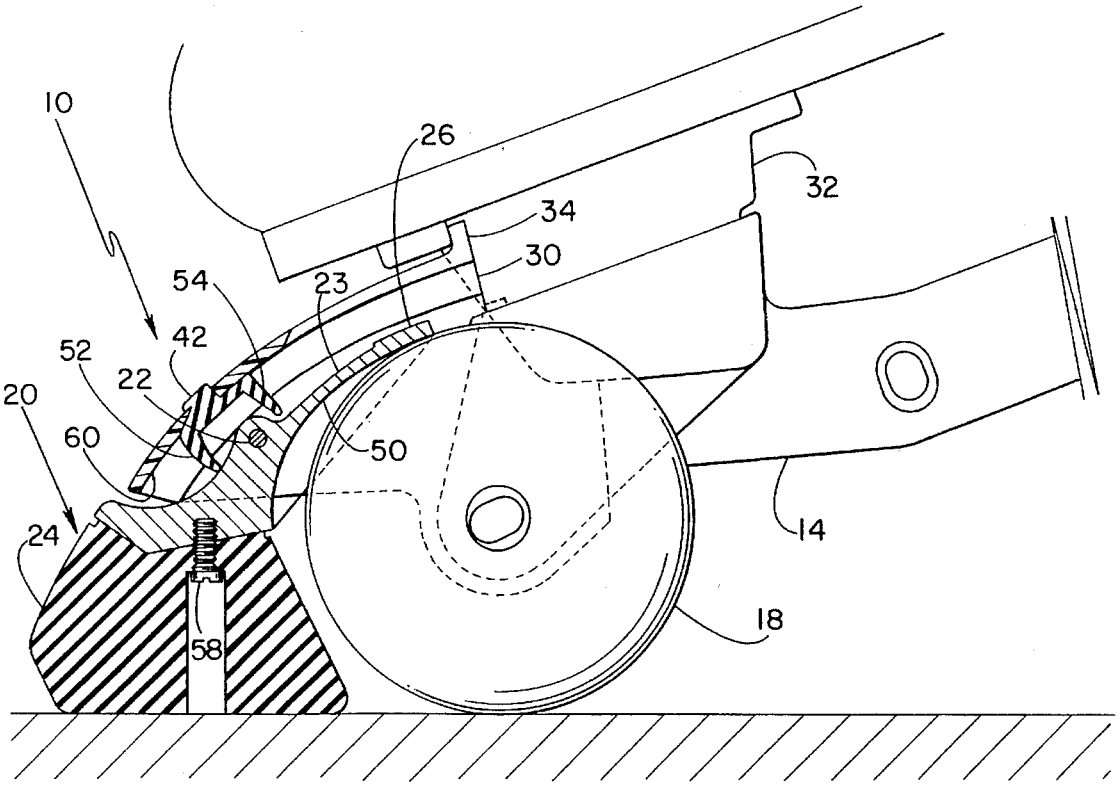
FIG. 3 is the same sectional view shown in FIG. 2 but with the brake skid pad urged by the skater to engage the ground such that the oppositely disposed arcuate-shaped tongue is caused to frictionally engage the rear wheel circumference to restrict rotation thereof.

Referring now to FIG. 3, anti-lock brake member 10 is shown wherein a braking operation is undertaken by the skater lifting the toe of the boot upward such that ground engaging end or skid pad 24 firmly engages the ground. Consequently, arm 23 will pivot about pivot member 22. When a hard braking operation is undertaken, finger 52 will yield (as shown) such that distal end 26 will be urged against the circumference or ground engaging surface of rear wheel 18 to retard free rotation of rear wheel 18. Thus, the inline skate is slowed due to a pair of braking operations. Normally, first, skid pad 24 engaging the earth, and secondly, the inner concave surface 50 of arm 23 establishing friction with the surface of rear wheel 18. However, it is to be recognized an auxiliary wheel could be implemented in place of skid pad 24 such that inner concave surface 50 provides the entire braking operation.

During the braking operation rear wheel 18 remains in contact with the ground and receives some weight from the skater. However, the friction established between member 23 and rear wheel 18 restricts rotation thereof, but does not lock-up rotation thereof. Thus, an anti-lock braking operation is performed. Further, the inner surface 50 of arm member 23 proximate distal end 26 provides a large contact surface engaging the circumference or ground engaging portion of rear wheel 18. Thus, a large amount of friction is established, however, an acceptable amount of heat will be generated but dispersed throughout heat conductive aluminum arm 23, yet rear wheel 18 will not become over heated and melt. Further, because the wheel engaging surface 50 of arm 23 is arcuately shaped when viewed from the side, as shown in FIG. 3, and because surface 50 has a concave surface when viewed from the end (see FIG. 4) which conforms to the rounded surface of wheel 18, the ground engaging surface of wheel 18 will not become deformed, and will wear evenly. Thus, wheel engaging surface 50 conforms to the contour of rear wheel 18 to provide even wear to rear wheel 18.

One principle feature of this invention is that during a moderate braking operation, only the ground engaging end or rear brake skid pad 24 will engage the earth, and distal end 26 will not necessarily engage the ground engaging surface of rear wheel 18 until a strong braking operation is performed, as shown in FIG. 3. Thus, the tongue portion of arm 23 defined between pivot member 22 and distal end 26 will only wear the outer surface of rear wheel 18 during a severe braking operation. Still referring to FIG. 3, it will be seen only rear the rear resilient finger 52 will engage arm 23 to resiliently inhibit rotation of arm 23 about pivot member 22. The forward resilient finger 54 will no longer engage arm 23, as shown. Again, resilient finger 52 of member 42 allows the user of the skate to selectively implement this second braking feature of establishing friction between end 26 and wheel 18. The primary braking element 24 will always be used first, and may be all that is ever needed during a typical braking operation. Again, however, an auxiliary wheel could be used in place of skid pad 24 and distal end 26 provides the braking element.

Figure 4:
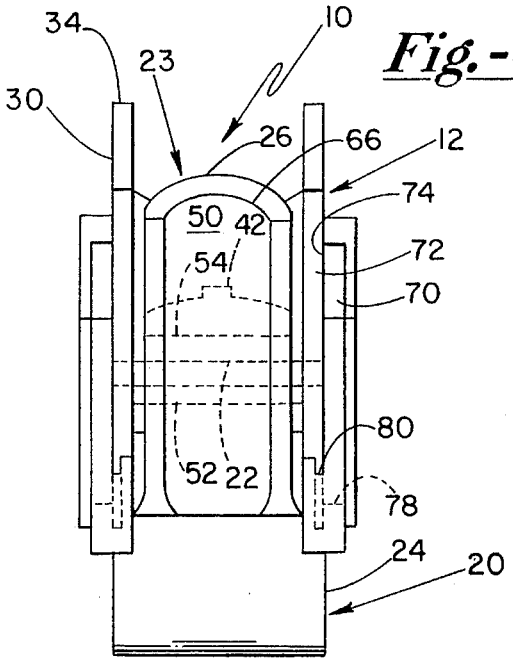
FIG. 4 is an end sectional view 4—4 shown in FIG. 1 illustrated the arm disposed between the housing side members to illustrate the slots defined on the inner surfaces of the side members for selectively securingly receiving the wheel frame which is located each side of the rear wheel.

Now referring to FIG. 4, an end view of 4—4 from FIG. 1 is shown. As discussed earlier, the arcuate shape of inner surface 50 of arm 23, illustrated at 66, closely conforms to the surface of rear wheel 18 to insure a large surface area engages rear wheel 18 during a hard braking operation. Again, this large surface area which engages rear wheel 18 insures that rear wheel 18 does not become overheated due to the friction, and further, that any wear which may result to rear wheel 18 is uniform so as to not degrade the performance of wheel 18.

Also shown in FIG. 4 is the coupling portion each side member 30 of housing 12. As shown, arm 23 is pivotably disposed between and secured to each side member 30. The frame coupling portion of each side member 30 includes a pair of slots or recesses which are adapted to securingly and selectively receive the yoked portion of frames 14 extending about each side of rear wheel 18. A first slot or recess 70 is defined which extends downwardly on an inside surface of each side member 30 and is adapted to receive the fastener or nut securing the axle through wheel 18. (See hidden lines in FIG. 1). A second and wider slot or recess 72 is defined in each side member 30 which also extends downwardly and at an angle, similar to slot 70, but which is shallower for receiving the respective yoked-shaped portion of frame 14 extending about the side of rear wheel 18. (See FIG. 1). Both slots 70 and 72 are parallel to one another, wherein a shoulder 74 defines an interface between the two slots of different depths. A narrow groove 80 (see hidden lines in FIG. 4) is defined in a lower portion of each side member 30 and is inclined forwardly for guiding the respective portion of frame 14 therein.

When brake 10 is adapted to frame 14 proximate rear wheel 18, the respective portion 76 of frame 14 extending about rear wheel 18 (see FIGS. 1 and 2) will be received within respective elongated slots 72 and notch 80 in a close friction fit. Thus, each side member 30 will be securingly engaged with respective side member 76 of frame 14. Again, first slot 70 is provided to receive and extend about the fastener securing the axle through rear wheel 18, which fastener will eventually reside at the bottom of slot 70 and reside proximate a shoulder 78 which is defined slightly above the bottom of second slot 70.

Also shown in FIG. 4 with hidden lines is resilient member 42 which is disposed on the back side of tongue or member 23, wherein the upper or forward resilient finger 54 will engage the back surface of 23 above pivoting fastener 22, and the lower resilient finger 52 will engage the back surface of arm 23 below pivot member 22.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

We claim:

1. A brake for use with a recreational device having a rear wheel having a ground engaging surface, rotatably mounted in a device frame, the brake comprising:

(a) a rigid brake housing having securing means formed integral to said brake housing for selectively securing said brake housing to said device frame proximate said rear wheel, whereby said brake housing securing means independently, securely, frictionally receives said device frame, said brake housing defined by a pair of side members and an end member extending therebetween and together defining a clearance, said side members each having a distal end adapted to abut said device frame proximate said rear wheel;

(b) an elongated braking member pivotably coupled to each said brake housing side members at a respective pivot point and at least partially disposed within said clearance, said braking member having a first end extending outside the clearance and including a ground engaging member, and having a second end disposed opposite said pivot points and substantially with said clearance proximate said rear wheel ground engaging surface when said brake is coupled to said recreational device; and (c) a resilient member disposed between said first end of said braking member and said housing end member for resiliently restraining said second end from engaging said rear wheel until the user causes the first end of the braking member to engage the ground with a sufficiently large force, said resilient member has a generally U-shape, said resilient member straddling said braking member pivot point.

2. A brake for use with a recreational device having a rear wheel with a ground engaging wheel surface rotatably mounted in a device frame, the brake comprising:

(a) a brake housing defining a clearance and a central portion thereof and having a pair of side members and a forward portion including securing means formed integral to said brake housing for selectively securing said brake housing to said device frame proximate said rear wheel, said housing securing means comprises at least one slot formed in said pair of side members of said brake housing for securingly receiving said device frame proximate said rear wheel, whereby said brake housing securing means independently, securely, frictionally receives said device frame; and (b) a unitary arm having a midsection pivotably coupled to said brake housing at a pivot point and having a ground engaging end and a braking means defined on opposite sides of said pivot point for selectively braking said device, said ground engaging end adapted to be selectively engaged with the ground and said braking means disposed proximate said rear wheel ground engaging surface when said brake housing is adapted to said device frame, such that when said brake is adapted to the recreational device proximate the rear wheel and said ground engaging end is caused by the user to engage the ground said arm responsively pivots about said pivot point and said braking means is caused to be urged against said rear wheel ground engaging surface to retard rotation of said rear wheel.

3. The brake as set forth in claim 2 wherein said braking means comprises a tongue having a concave surface facing said rear wheel ground engaging surface.

4. The brake as set forth in claim 3 wherein said concave surface is elongated in an arcuate shape.

5. The brake as set forth in claim 2 further comprising a means for resiliently restraining said braking means from engaging said rear wheel ground engaging surface until the user causes the arm ground engaging end to engage the ground with a sufficiently large force.

6. The brake as set forth in claim 5 wherein said resilient means is securingly disposed between said arm and said housing.

7. The brake as set forth in claim 6 wherein said resilient means is disposed along said arm between said pivot point and said ground engaging end.

8. A brake for use with a recreational device having a rear wheel having a ground engaging wheel surface, rotatably mounted in a device frame, the brake comprising:

(a) a rigid brake housing defined by a pair of side members and an end member extending therebetween and together defining a clearance, said side members each having a distal end adapted to abut said device frame .proximate said rear wheel, each said distal end including tabs extending upwardly therefrom, said rigid brake housing having securing means formed integral to said brake housing for selectively securing said brake housing to said device frame proximate said rear wheel, said housing securing means including at least one slot formed in said side members of said brake housing for securingly receiving said device frame proximate said rear wheel, whereby said brake housing securing means independently, securely, frictionally receives said device frame; and (b) an elongated braking member pivotably coupled to each said brake housing side members at a respective pivot point and at least partially disposed within said clearance, said braking member having a first end extending outside said clearance and including a ground engaging member, and having a second end disposed opposite said pivot points and substantially within said clearance proximate said rear wheel ground engaging surface when said brake is coupled to said recreational device.

9. The brake as set forth in claim 8 wherein said second end of said braking member comprises an elongated tongue extending about the ground engaging surface of the rear wheel.

10. The brake as as set forth in claim 9 wherein said ground engaging member comprises a brake skid pad.

11. The brake as set forth in claim 9 where said tongue has a concave surface facing said rear wheel outer surface.

12. The brake as as set forth in claim 11 wherein said tongue is elongated and is curved.

13. The brake as set forth in claim 8 and further comprising a resilient member disposed between said first end of said braking member and said housing end member for resiliently restraining said second end from engaging said rear wheel until the user causes the first end of the braking member to engage the ground with a sufficiently large force.

14. A brake for a recreational device having a rear wheel having a ground engaging wheel surface rotatably mounted in a device frame, the brake comprising:

(a) a brake housing defined by a pair of side members and an end member extending therebetween and together defining a clearance, said brake housing having securing means integral with said brake housing for selectively securing said brake housing to said device frame, said securing means comprising a slot defined in each side member for securingly receiving said device frame on respective sides of said rear wheel, whereby said brake housing securing means independently, securely, frictionally receives said device frame; and (b) a braking member coupled to said brake housing and including a ground engaging member.

15. The brake as set forth in claim 14 wherein said side members each having a distal end adapted to abut said device frame proximate said rear wheel and said braking member is at least-partially disposed within said clearance, said braking member having a first end extending outside said clearance and including said ground engaging member.

16. The brake as set forth in claim 15 wherein said securing means is formed integral to said brake housing side members, said securing means being shaped to couple to said device frame proximate said rear wheel.

17. A brake for a recreational device having a rear wheel having a ground engaging wheel surface rotatably mounted in a device frame, the brake comprising:.

(a) a brake housing defined by a pair of said members and an end member extending therebetween and together defining a clearance, said brake housing having securing means integral with said brake housing for selectively securing said brake housing to said device frame, securing means comprises a slot defined in each side member for securingly receiving said device frame on respective sides of said rear wheel and said securing means being shaped to couple to said device frame proximate said rear wheel said brake housing securing means independently, securely, frictionally received said device frame; and (b) a braking member coupled to said brake housing and including a ground engaging member, said side members each having a distal end adapted to abut the device frame proximate said rear wheel and said braking member is at least partially disposed within said clearance, said braking member having a first end extending outside such clearance and including ground engaging member.

18. The brake as set forth in claim 17 wherein said braking member is pivotably coupled to said brake housing.

* * * * *